United States Patent [19]

Williamson et al.

[11] 4,189,793

[45] Feb. 26, 1980

[54] AUTOMATIC LIQUID DISPENSER FOR AN INVERTED BOTTLE

[75] Inventors: Clifton L. Williamson; Harvey L. Hocker, both of Fort Bragg; John M. Alcamo, Modesto, all of Calif.

[73] Assignee: Northwest Sanitation Products, Inc., Fort Bragg, Calif.

[21] Appl. No.: 726,921

[22] Filed: Sep. 27, 1976

Related U.S. Application Data

[63] Continuation-in-part of Ser. No. 631,385, Nov. 12, 1975, abandoned.

[51] Int. Cl.[2] ..... E03D 9/02

[52] U.S. Cl. ..... 4/228; 4/227; 222/57; 222/448; 222/453; 222/519

[58] Field of Search ..... 4/222, 227, 228; 222/57, 444, 443, 448, 453, 56, 519, 541, 543

[56] References Cited

U.S. PATENT DOCUMENTS

| | | | |
|---|---|---|---|
| 2,913,734 | 11/1959 | O'Hare | 4/227 |
| 2,967,310 | 1/1961 | O'Hare | 4/227 |
| 3,698,021 | 10/1972 | Mack et al. | 4/227 |
| 3,766,570 | 10/1973 | Finneran | 4/228 X |
| 3,841,524 | 10/1974 | Easter | 4/227 |
| 3,908,209 | 9/1975 | Fillmore | 4/227 |

*Primary Examiner*—Henry K. Artis

*Attorney, Agent, or Firm*—Owen, Wickersham & Erickson

[57] ABSTRACT

A liquid dispenser for dispensing liquid from an inverted bottle into a tank at times when water in the tank drops below a buoying level. A hollow annular stationary member closes off the bottle's neck and has an annular diaphragm leading to a tube with seats at its upper and lower ends. A movable member has two portions that are slidable in the said tube and are joined by a measuring portion. It seats against one seat in its upper position with the measuring portion then wholly above the tube and against the other in its lower position, with the measuring portion then wholly below the tube, and it is moved between them by the change of water level in the tank. This movement is aided with a buoying skirt having an annular chamber that is normally filled with water and drains only after falling; the same chamber helps to dispose the measured charge of the other liquid.

20 Claims, 10 Drawing Figures

AUTOMATIC LIQUID DISPENSER FOR AN INVERTED BOTTLE

CROSS-REFERENCE TO RELATED APPLICATION

This application is a continuation-in-part of Ser. No. 631,385, filed Nov. 12, 1975 and now abandoned.

BACKGROUND OF THE INVENTION

This invention relates to a liquid dispenser and is particularly useful as a dispenser for toilet bowl cleaners, though it can be used in other installations where liquid is to be dispensed into water or some other liquid, and in which the liquid acts as a buoying force for holding the dispenser in a normally closed position and causes the liquid to be dispensed into the water when the water level drops.

Dispensers for toilet bowl cleaners have normally operated on a different principle, namely, the principle of having the buoying force of the water in the tank cause dispensing of the charge and therefore to mix the toilet bowl cleaner with the contents of the tank at the time when the tank has just been filled. When the tank is emptied by flushing, no further dispensing takes place until the tank is once again nearly full, at which time the next dispensing takes place.

One of the disadvantages of this prior-art type of operation is that the material is dispensed into water filling the entire toilet tank, and the diluted solution remains there, possibly for long periods of time. Also, the eventual solution is so dilute that more material may be required than would be the case where the dispensing can be done at the time of flushing and after the water level has dropped enough so that a relatively concentrated charge of diluted solution is available for cleaning the toilet bowl during the only time that the material is really acting as a cleaner. So long as the liquid being dispensed is one which diffuses itself very rapidly into the water in the tank there is nothing to be gained by dispensing it long before it it used, and the loss in concentration is certainly of no benefit.

Therefore, one object of the present invention is to enable one to obtain better cleaning action with even less fluid by dispensing it at a time when it can act in a stronger more concentrated solution during the relatively brief interval when the solution performs its cleaning action.

The present invention may be considered to be an improvement over U.S. Pat. No. 3,841,524, and acts on the same basic principle. However, it does so with fewer parts and with better and surer action. Also, its manufacture requires fewer molds and results in simplifying assembly. Furthermore, it is less expensive to manufacture even though it obtains better results.

A device operating in the same basic manner as U.S. Pat. No. 3,841,524 is shown in U.S. Pat. No. 3,908,209, issued to William E. Fillmore. This device comprises three elements and meters the fluid it dispenses in such a way that the heavy viscous liquid cannot be repeatedly measured accurately, some of it tending to remain in the metering chamber, partly because it tends to plug narrow passageways therebelow and thereby to prevent adequate access of air to the metering chamber. Also, the Fillmore device requires a very large bottle cap and fails to provide the required resiliency needed for the operating parts in order to seal the bottle adequately when capped. Other difficulties with Fillmore are also solved by the present invention which has further advantages also, discussed below.

SUMMARY OF THE INVENTION

The liquid dispenser of this invention includes only two pieces, one of which is stationary and the other of which is movable.

The stationary member is a hollow annular member having a portion that engages the neck of the bottle and is joined by an annular diaphragm to an inner depending tube which has a seat at each end, that is, at its upper and lower ends. Preferably, the tube is cylindrical, and the seats are circular.

The movable member has an upper portion that is slidable in the tube, is approximately the same length as the tube and at its upper end has a seating flange for engagement with the upper seat of the tube to prevent flow between the two members when the movable member is in its lower position. The movable member also has a lower portion of the same cross section and, preferably, the same length as the upper portion. The lower portion terminates in a seating shoulder which provides sealing engagement with the lower seat of the tube when the movable member is in its upper position. Preferably, the upper and lower portions are cylindrical, and the upper seating flange and the seating shoulder are circular.

The upper and lower portions are joined by a charge-measuring portion, preferably a web with vertical radial ribs. The charge-measuring portion preferably lies just below the lower seat when the movable member is in its upper position and just above the upper seat when the movable member is in its lower position. The lengths of these upper and lower portions relative to the length of the tube is important in assuring that the charge-measuring portion is fully exposed at both ends of its travel: fully above the tube in its upper position and fully below it in its lower position. This is of significance in achieving accuracy of charge, helping to assure complete fill and complete dispensing of the liquid to be dispensed.

The movable member also has a depending preferably skirt-like portion which hangs down from the seating shoulder and is buoyed up to move the movable member up to its upper position when liquid lies at its normal, upper level. This skirt-like portion includes an annular chamber with a small opening through the bottom. After the movable member has been buoyed up to its upper position, the annular chamber gradually fills with water coming up through the small opening. Then, when the liquid level drops abruptly, as during flushing, the weight of the water in this annular chamber helps to aid the movable member in moving quickly down to its lower position. Moreover, the water then drains out the bottom opening while the liquid to be dispensed largely if not entirely flows down the movable member into the annular chamber and is dispensed from there through the opening in the bottom.

As stated above, the device is used when the bottle is in its inverted position. Ordinarily, when the bottle is being stored or is standing on a store shelf, the bottle is in an upright position with a cap covering the dispensing device. When the bottle is placed in use, the cap is removed and the bottle is inverted. The movable member, if not buoyed up, then drops down to its lower position, so that the upper flange engages the upper seat and prevents passage of liquid. When water fills the tank in which the device is secured, this water buoys up the skirt portion and raises the lower member upwardly, thereby carrying the flange away from the upper seat. The charge-measuring portion, as it moves up, goes up above the upper seat. When the tank is flushed the charge-measuring portion drops down below the depending tube and carries with it a charge of the liquid in the bottle. Since the two cylindrical portions are made to have relatively close clearance with the cylindrical tube, loose enough only to avoid sticking and enable free movement up and down, the measurement of the charge is done wholly by the size of the web portion.

Other objects and advantages of the invention will appear from the following description of a preferred embodiment.

DESCRIPTION OF A PREFERRED EMBODIMENT

Figure 1:
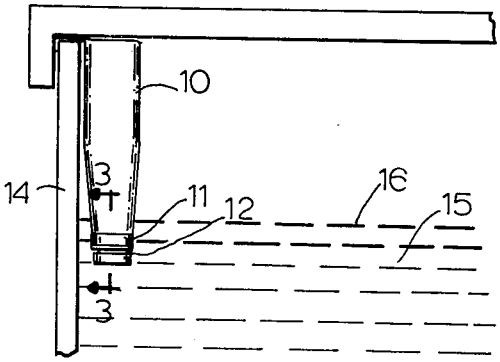
FIG. 1 is a fragmentary view in elevation and in section of a portion of a toilet tank in which an inverted bottle holding a valve embodying the principles of the invention is suspended in operative position. The valving or dispensing mechanism of this invention is held in its charging and non-dispensing position by the buoying force of the water in the tank acting on the movable member of the dispenser.
Figure 2:
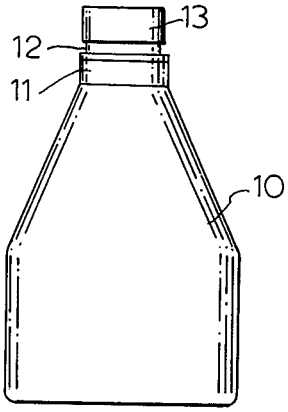
FIG. 2 is an enlarged view in elevation and in section of the bottle of FIG. 1 shown in its closed and upright position with a closure cap on it.

The invention makes use of a bottle 10 which may be especially made for use with this invention or may be a conventional bottle with a neck 11 related in size to a dispensing assembly 12 of the invention. The bottle 10 is shown in its upright position in FIG. 2 and its top is then closed by a cap 13, while in FIGS. 1, 3, and 4 the bottle 10 is shown in inverted position in a toilet tank 14 with the cap 13 removed. The tank 14 is filled with water 15 up to a normal level 16.

Figure 3:
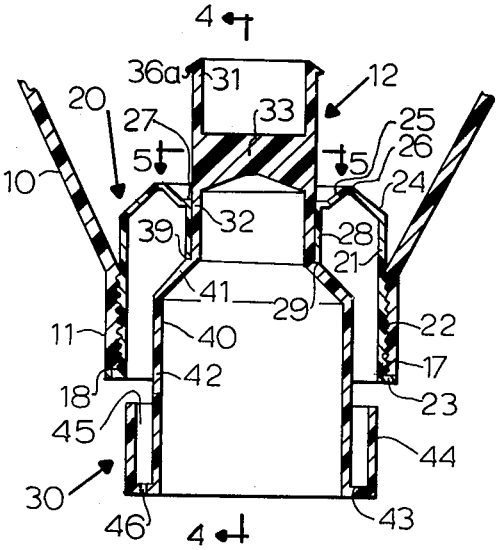
FIG. 3 is a further enlarged view in elevation and in section taken along the line 3—3 in FIG. 1.
Figure 4:
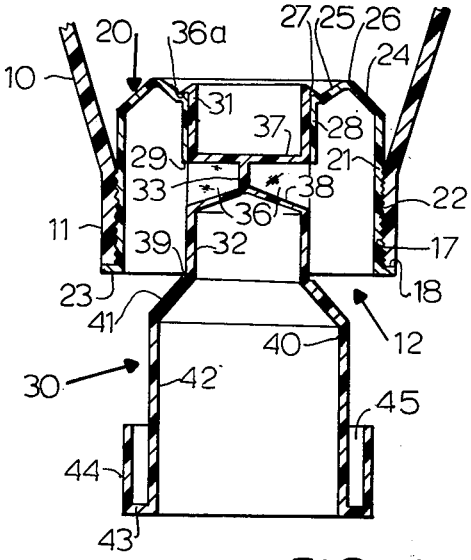
FIG. 4 is a view in section taken along the line 4—4 in FIG. 3 and showing the movable member in its lower position, which it assumes when the buoying force of the water is withdrawn from the movable member.

As shown in FIGS. 3 and 4, the dispensing device 12 includes a stationary member 20 having an outer, preferably generally cylindrical portion 21 with an outer surface 22 which is roughened or otherwise suitably formed to seal fast against the inner surface 17 of the neck 11 of the bottle 10. The member 20 may have a flange 23 that overlies the end 18 of the neck 11.

The stationary member 20 has a generally radially-extending diaphragm which may comprise a pair of frustoconical portions 24 and 25 meeting at a rounded vertex 26 and leading inwardly to a flat seat 27. The portions 24 and 25 act as a bellows-like yielding member to enable sealing the lower end of the member 90 against the cap 13 when the cap 13 is on the bottle 10. From the seat 27 depends an inner cylindrical tubular portion or tube 28 having a second, lower seat 29 at its lower end.

Figure 5:
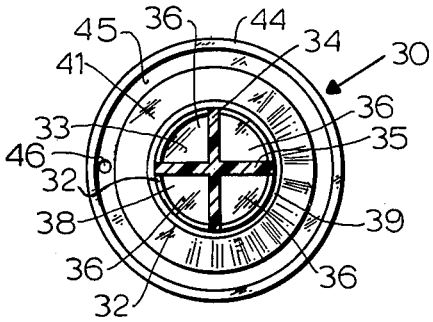
FIG. 5 is a view in section of the movable member taken along the line 5—5 in FIG. 3.

The dispensing assembly 12 also incorporates a movable member 30 preferably having at its upper end a first hollow cylindrical portion 31 and spaced downwardly therefrom a second hollow cylindrical portion 32. The two cylindrical portions 31 and 32 are connected together by a charge-measuring portion 33, which may comprise a pair of crossing radial ribs 34 and 35 with measuring spaces 36 between them, as shown best in FIG. 5. The ribs 34 impart rigidity to the charge-measuring portion 33, so that the tendency for relative movement between the portions 31 and 32 is greatly reduced as compared with the structure that would result from a connection between the portions 31 and 32 by only a central hollow stem. Moreover, the ribs 34 lie close enough to the wall 28 to prevent relative movement between the members 20 and 30, even when the charge-measuring portion 33 is directly opposite the wall 28.

The upper end of the upper cylindrical portion 31 is provided with a preferably circular flange **36*a* which is adapted to seal against the upper seat 27 when the device is in its lower or FIG. 4 position. In this position the liquid in the bottle 10 is retained in the bottle 10. The upper portion 31 is preferably made substantially the same length (i.e., vertical height) as the inner cylindrical tube 28, and the lower portion 32 is preferably made the same diameter (or cross-section) and the same length. While the portions 31 and 32 fit loosely enough in the tube 28 to slide relatively easily in the tube 28**, still they fit snugly enough so that there is very little clearance between them and the tube.

The charge-measuring portion 33 preferably lies between a horizontal wall 37 closing off the upper portion 31 and a preferably somewhat conical upper end 38 of the lower portion 32, for helping in dumping the measured charge. An upper somewhat conical wall 48 can also be used (see FIG. 6). At the lower end of the lower cylindrical portion 32 is a radial shoulder 39 which seats snugly against the lower seat 29 of the tube 28 when the movable portion 30 is in its upper position, shown in FIG. 3. At that time the shoulder 39 and seat 29 act as an effectual seal to prevent leaks from the bottle 10, aided by the relative snugness of the upper cylindrical portion 31 in the cylindrical tube 28.

Figure 6:
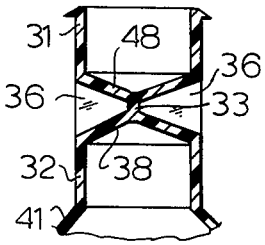
FIG. 6 is a fragmentary view of a portion of a modified form of movable member.
Figure 7:
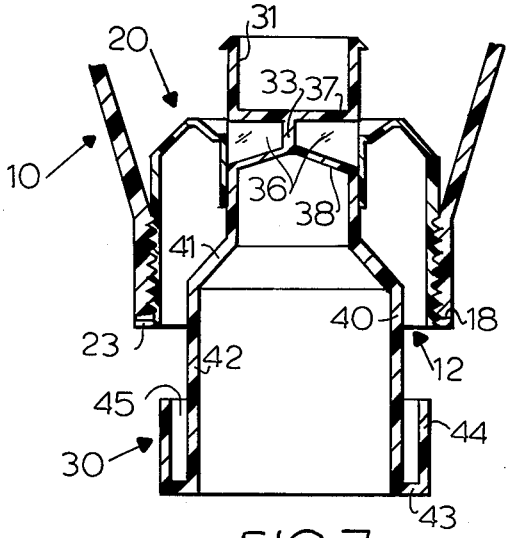
FIG. 7 is a view similar to FIG. 4 and is taken along the same line 4—4 in FIG. 3, but showing the movable member in an intermediate position between its upper and lower positions, this position being present only temporarily while the device is moving.

As shown in FIG. 3, the charge-measuring portion 33 is fully above the tube 28, when the movable member 30 is in its upper position. This assures good and complete filling of the measuring spaces 36, which are fully exposed. Their location also enables the maximum use of the fluid in the bottle 10. Moreover, as shown in FIGS. 4 and 6, the charge-measuring portion 33 lies fully below the tube 28 when the movable member 30 is in its lower position. This enables the charge-measuring spacers 36 to be fully exposed when they can completely drain. Further, the wide spacing of the movable member 30 from the stationary member 20 (from the measuring spacers 36 on down to the very bottom) helps to admit air to replace the draining liquid, whereas close spacing tends to prevent such complete draining. Therefore, the device dispenses the same amount each time until the bottle 10 is empty.

Below the lower cylindrical portion 32 is provided a depending skirt-like portion 40 which is primarily adapted to add to the weight of the member 30 to cause it normally to drop down quickly and also to regulate its buoyancy so that it can be properly buoyed up by liquid in the tank 14. Thus, there may be a frustoconical portion 41 leading to a larger cylindrical portion 42, which ends in a radially outwardly extending portion 43 that, in turn, leads to an upturned cylindrical portion 44. In between the portions 42 and 44 is an annular chamber 45, having a small opening 46 through the bottom wall 43. This skirt-like portion 40 is adapted for the buoying and weighting functions described, and other forms could be given to it.

Thus, when the movable member 30 is in its upper position shown in FIG. 3, the waterline is above the upper end of the portion 44, so that the annular chamber 45 fills with water, partly through the small opening 46 and partly from above. The smallness of the opening 46 means that the water will not fill the chamber 45 until it has been fully buoyed up. For the same reason, when the tank 14 is flushed, the precipitate drop in water level causes the movable member 30 to drop smartly and then to drain out the water while the more viscous liquid in the bottle 10 (as measured by the portion 33) flows from the fully exposed spacers 36 down the exterior surface of the portions 32, 41, and 42 into the chamber 45 and thence slowly out through the opening 46, thereby metering the liquid at a constant rate into the water therebelow. Such liquid as may remain in the chamber 45 is gradually diluted and diffused into the tank 14 when the water level buoys up the movable member 30 and enters the chamber 45.

As shown, the portion of the member 30 above the charge-measuring portion 33 may be a hollow cylindrical shell and the portion below the charge-measuring portion 33 may also be a shell having the shape described. While the upper portion 31 could be closed over at the upper end, this would call for and extra piece, and it is undesirable anyway because the structure shown enables the easy assembly of the movable member 30 into the stationary portion 20 by the elastic temporary give of the wall 31. Furthermore, the liquid which enters the cavity surrounded by the wall 31 adds weight to the movable portion 30 and helps it to drop promptly on flushing. Similarly, the lower portion can be opened as shown.

The charge-measuring portion 33 is sized in such a way as to meter the amount to be dispensed each time. Thus, the volume defined between the ribs 34 and 35, the flat bottom 37 of the upper cylindrical portion 31, and the sloping top 38 of the lower cylindrical portion 32, is calculated to achieve the desired volume. This may be done by the slope concerned, by the thickness of the ribs 34 and 35 and, primarily, by the vertical spacing between the two cylindrical portions 31 and 32.

Thus, in storage the bottle 10 is either capped or covered with a suitable protecting device; when taken from the store and installed in the usual manner in the toilet tank 14, with whatever aids are desired for hanging it upside down, the cap 13 being removed, the valve device 12 falls into the position shown in FIG. 4, from which it is moved up to the position shown in FIG. 3 by the buoying action of the water 15 in the tank 14. In the buoyed-up position, the charge-measuring portion 33 lies up above the sealed-off seat 27 and is filled by liquid in the bottle 10. When the tank 14 is flushed, the water level drops, and the weight of the water-filled skirt portion 40 of the inner member 30 and the weight of the liquid-filled cavity in the wall 31 cause the entire inner member 30 to drop, carrying with it the charge in the portion 33, which therefore is emptied down into the tank 14, flowing down the walls 32, 41, and 42 into the annular chamber 45 and from there into the water therebelow via the opening 46. Such of it as gets into the space between the two cylindrical portions 42 and 44 is insignificant and at any rate is normally in contact with the liquid 15. As the tank 14 fills each time, the water reaches the skirt portion 40 and buoys it up, forcing it up into the position of FIG. 3.

An important feature of the invention is the time delay caused by the viscosity of the liquid to be dispensed and the structure of the movable member 30. Thus, it takes some time for the viscous material to run down the outside walls of the movable member 30 and to enter the chamber 45. To this time is added the time taken by the liquid in dropping out through the opening 46. All this means that the tank 14 will be fully emptied and will be starting its refilling before the new charge of material is dispensed into the water. Thus, the charge is not lost during the flushing but is distributed in the water 15, as it should be. If the viscous liquid is not completely drained from the chamber 45, this will make no substantial difference because as the water begins buoying up the member 30, it enters the hole 46, so that the liquid inside the chamber 45 continues to be diluted into the water; in fact, when the water level rises so that it is above the top level of the member 44 and actually enters the chamber 45, this dilution and dispersion continues. However, almost all of the liquid will have been dispensed from the chamber 45 while it is in its lower position and while the tank is filling, and it will be only a small amount that adheres to the walls 42 and 44, which in themselves are rather slippery if made of suitable plastics. In either event, the water in the tank then is fully treated with the liquid which it dilutes.

DESCRIPTION OF ANOTHER EMBODIMENT

Figure 8:
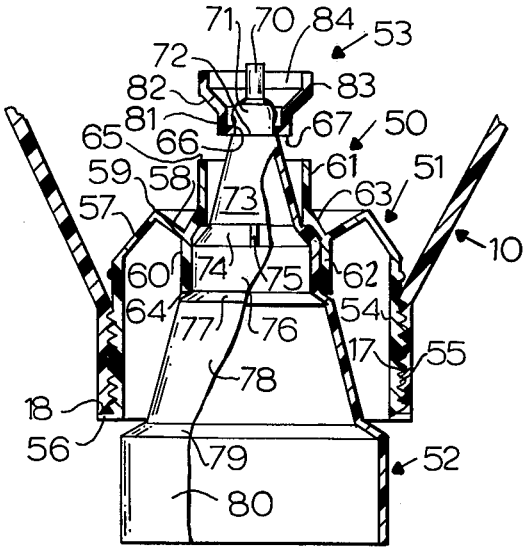
FIG. 8 is a fragmentary view in section of a modified form of the invention with the movable member shown in its upper position.
Figure 9:
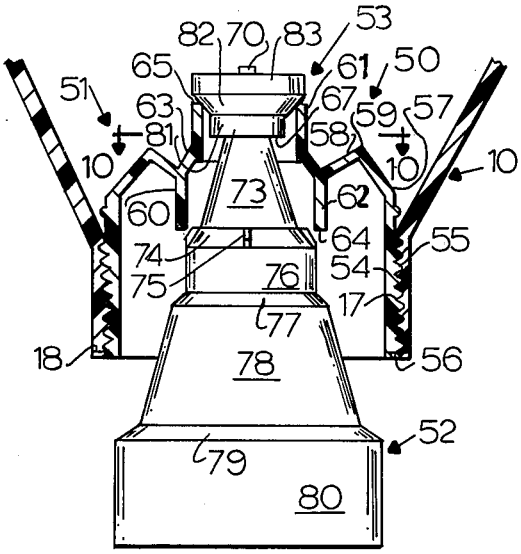
FIG. 9 is a similar view with the movable member shown in its lower position.
Figure 10:
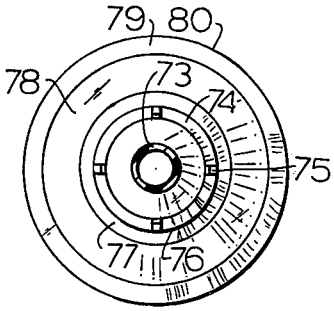
FIG. 10 is a view in section taken along the line 10—10 in FIG. 9.

A dispensing device 50 shown in FIGS. 8 through 10 comprises three members in conjunction with the bottle 10. These three members are a stationary member 51, a movable member 52, and a top seat-closing member 53.

The stationary member 51 is in many ways like the stationary member 20. That is, it has an outer preferably generally cylindrical portion 54 with an outer surface 55 which is roughened or otherwise suitably formed to seal fast against the inner surface 17 of a neck 11 of the bottle. The stationary member 51 may have a flange 56 that overlies the end 18 of the neck 11. The stationary member 51 also has a generally radially-extending diaphragm, which may comprise a pair of frustoconical portions 57 and 58 meeting at a rounded vertex 59 and leading inwardly to a radially inner portion 60.

The radially inner portion 60 of the stationary member 51 comprises an upper cylindrical portion 61 and a lower and wider cylindrical portion 62 joined to the portion 61 by a frustoconical portion 63. The lower end 64 of the lower portion 62 serves as a lower seat while the upper end 65 of the upper portion 61 serves as an upper seat.

The movable member 52 is somewhat more complex than the movable member 30 of the previous device, and it requires the addition of the third member 53. The movable member 52 comprises a stem 70 at its upper end which extends up from a wider portion 71, around which a central opening 66 through the third member 53 fits snugly. At the lower end of the portion 71 is a shoulder 72, against which a lower end wall 67 of the member 53 snugly abuts. Thus, the member 53 is retained in position by the snug fit between it and the portions 72 and by the abutment of its wall 67 on the shoulder 72. The portion 71 is hollow, as is all of the movable member 52 except for the stem 71. Below the shoulder 72 the member 52 is provided with a frustoconical portion 73, which leads, in turn, to another frustoconical portion 74 having a plurality of ribs 75, preferably four ribs 75. The frustoconical portion 74 is inclined at a less acute angle than the frustoconical portion 73, and it terminates at its lower end in a cylindrical portion 76 that leads to a still less acute frustoconical portion 77 which acts as a seat-engaging member for the lower seat 65 of the stationary member 51, as shown in FIG. 8 in which the movable member 52 is at its upper position with the seat 65 firmly seated against the seat-engaging portion 77. Below the seat-engaging portion 77 is another frustoconical portion 78 which is approximately at the more acute angle of the portion 73. This portion 78 is followed by another flatter frustoconical portion 79 from which depends a generally cylindrical skirt 80 to a lower end. It will be noted that there is a good clearance between the movable member 52 and the stationary member 51 at all places and positions, except insofar as the inner portion 60 of the stationary member 51 is concerned and that there is good clearance even there when the movable member 52 is in its lower position, as in FIG. 9.

When it is in the lower position of FIG. 9 the member 53 engages the upper seat 65 and closes off the flow of liquid. The member 53, made separate here so as to enable easy assembly, comprises (in addition to its central opening 66 which fits snugly around the portion 71, and its lower end wall 67 that fits snugly against the shoulder 72) a lower cylindrical portion 81 leading up from the end wall 67, an upwardly and outwardly flared frustoconical portion 82 and an upper cylindrical portion 83. The frustoconical portion 82 acts as a seat-engaging member to engage the upper seat 65 and prevent leakage of the liquid from the bottle 10 when the movable member 52 is in its lower position. An upper cup portion 84 holds a little of the liquid and adds to the weight of the movable member 52.

As shown by a comparison of FIGS. 8 and 9, when the movable member 52 is in its upper position (FIG. 8), the charge is measured as being above the lower seat 64 and the seat-engaging member 77. Since the lower cylindrical portion 61 of the stationary member lies very close to the cylindrical portion 76 of the movable member 52, though free enough to enable relative movement, the actual charging begins at the upper edge of the cylindrical portion 76 where it meets the frustoconical portion 74. The ribs 75 help to center the member 52 in the member 51 and to space the surface 74 apart from the portion 63.

When the flushing of the tank 14 takes place, the movable member 52 drops quickly to the lower portion shown in FIG. 9, carrying that charge down, and in short order the seat-engaging portion 82 of the member 53 engages the upper seat 65 of the stationary member 51. At that time, the whole charge lies below the upper seat 65 and is sealed off from the other liquid in the bottle 10. The charge then drains freely from the charging portion, because there is plenty of clearance between the movable member 52 and the stationary member 51 even at and around the lower seat 64 of the stationary member 51.

The liquid that is dispensed from the charge-measuring portion flows down the walls 76, 77, 78, 79, and 80 and drips from the lower end of the skirt 80 into the water therebelow. The time it takes before it drips off is significant in assuring that the liquid is not largely lost during the flushing. Since the liquid in the bottle is viscous, this time is appreciable and serves to delay the entrance of the fresh charge until the tank 14 has been emptied and begins to refill.

The embodiment 50 of FIGS. 8–10 is not considered to be as desirable as the preferred embodiment shown in FIGS. 1–7, but it is a workable device with possibly some advantages in molding for some manufacturers.

Another advantage of the device 12 of FIGS. 1–7 is its suitability for a refillable bottle in which the stationary member 20 is permanently in place in the bottle 10. For refilling, the movable member 30 can be pulled out from the stationary member 20 without damage to either and can be replaced after the bottle has been refilled, and this can be done many times, due to the flexibility and elasticity of the portion 31. In contrast, the movable member 52 of the device 50 of FIGS. 8–10 can be withdrawn from the stationary member 51 only by first pulling the member 52 loose from the member 53, which would then fall to the bottom of the bottle 10 and could not be replaced so long as the stationary member 51 is in place in the bottle 10. Normally, the stationary member 20 or 51 is put permanently into the bottle and sealed there.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. A liquid dispenser for use in dispensing liquid from an inverted bottle having a neck into a tank at times when water in the tank drops below a normal, buoying level, including in combination:

a hollow annular stationary member having a neck-engaging portion joined by an annular radially inwardly-extending diaphragm to an inner tubular seat portion having at its ends an upper seat edge and a lower seat edge, and a movable member comprising a piston that is slidable in said tubular seat portion and otherwise widely spaced from said stationary member, said movable member having an upper portion and a lower portion spaced apart by a charge-measuring portion and having adjacent its upper end first seating means for engaging the tubular seat portion and said upper seat edge to prevent flow therebetween, said charge-measuring portion, when said movable member is in a lower position with said upper edge engaged, then discharging its charge below said lower seat edge, said movable member having adjacent its lower end second seating means for engaging the tubular seat portion and said lower seat edge, said charge-measuring portion when said movable member is in an upper position with lower seat edge engaged, then receiving its charge, being open above said upper seat edge, said lower portion of said movable member including a buoying portion having a first vertical wall, an outwardly extending bottom wall at the lower end, of the first vertical wall and an upwardly extending vertical wall extending up from said bottom wall to provide an annular chamber having a small drain opening through said bottom wall, said buoying portion serving to buoy said movable member up to said upper position when the water in said tank rises to a normal storage level, said charge-measuring portion then being filled by liquid from said bottle, and serving by its weight and that of slowly draining water in said annular chamber to carry said movable member down to said lower position when the water level drops, and then to discharge the liquid contents of said measuring portion, which flow down said first wall from said measuring portion.

2. The liquid dispenser of claim 1 wherein said upper portion comprises a cup-shaped portion with a closed bottom and an open upper end, serving to aid the assembly together of said stationary and movable members.

3. The liquid dispenser of claim 1 wherein accurate measurement of each charge is aided during filling by said charge-measuring portion lying wholly above said tubular seat portion when said lower seat edge engages said second seating means and during discharge by said charge-measuring portion lying wholly below said tubular portion when said upper seat edge engages said first seating means and by the absence of any close spacing of said movable member relative to said stationary member below said tubular portion.

4. A liquid dispenser for use in dispensing liquid from an inverted bottle having a neck into a tank at times when water in the tank drops below a buoying level, including in combination:

a hollow annular stationary member having a neck-engaging portion joined by an annular diaphragm to an inner depending tube having a first seat at its upper end and a second seat at its lower end, and a movable member comprising an upper portion and a lower portion spaced apart by a measuring portion, all of which are slidable, with relatively close clearance, in said tube, said movable member being otherwise spaced well apart from said stationary member, said upper portion being approximately the same length as said tube and having at its upper end a seating flange for engaging said first seat and preventing flow therebetween when said movable member is in a lower position, said measuring portion then lying wholly below said tube, for improved drainage therefrom of a measured charge, said movable member's lower portion terminating in a seating shoulder for sealing engagement with said second seat when said movable member is in an upper position, said measuring portion then lying wholly above said tube, for improved filling of said measuring portion with a measured charge, said movable member having a buoying portion depending from said shoulder, serving to buoy said movable member up to said upper position when the liquid in said tank is at a normal storage level and serving by gravity to carry said movable member down to said lower position when the liquid level drops, to discharge the contents of said measuring portion.

5. The liquid dispenser of claim 4 wherein said buoying portion has a first vertical wall depending from said shoulder and an outwardly extending bottom wall joining said first vertical wall to a second shorter vertical wall, coaxial therewith and extending up therearound, thereby providing an annular chamber with a small drain opening through said bottom wall.

6. A liquid dispenser for use in dispensing liquid from an inverted bottle having a neck into a tank at times when water in the tank drops below a buoying level, including in combination:

a hollow annular stationary member having a neck-engaging portion joined by an annular diaphragm to an inner depending cylindrical tube having a first circular seat at its upper end and a second circular seat at its lower end, and a movable member comprising an upper cylindrical portion, a lower cylindrical portion, and a measuring portion comprising vertical radial ribs between an upper closed end and a lower closed end, said measuring portion being separated by and joining together said upper and lower portions, said upper and lower portions and said ribs all being slidable, with relatively close clearance, in said tube, said movable member at all other places being spaced widely from said stationary member, said upper cylindrical portion being approximately the same length as said tube and having at its upper end a circular seating flange for engaging said first seat and preventing flow therebetween when said movable member is in a lower position, said measuring portion lying wholly below said second seat when said flange engages said first seat, to improve dumping of the charge, said movable member having a lower cylindrical portion of the same diameter and length as said upper cylindrical portion and terminating in a circular seating shoulder for sealing engagement with said second seat when said movable member is in an upper position, said measuring chamber then lying wholly above said first seat to insure accurate filling with the measured charge, said movable member having a buoying skirt portion depending from said shoulder, serving to buoy said movable member up to said upper position when there is liquid for said skirt portion to be buoyed by and helping by gravity to carry said movable member down to said lower position when there is no buoying liquid.

7. The dispenser of claim 6 wherein said skirt portion comprises an upper frustoconical portion, a depending cylindrical portion, and another outer cylindrical portion connected to said depending cylindrical portion by an annular radial wall at the lower end of both to provide an annular chamber therebetween having a small drainage opening through said annular radial wall.

8. The dispenser of claim 6 wherein said measuring portion is bounded by the lower end of said upper cylindrical portion and a sloping upper end of said lower cylindrical portion.

9. The dispenser of claim 6 wherein said upper cylindrical portion is a cup with a closed bottom and an open end and able to flex for installation up through said tube.

10. Apparatus for dispensing metered amounts of fluid, which comprises, in combination:

a container for said fluid, said container including a body portion and a neck portion defining an opening into said container, a stationary guide member secured in said neck and filling the opening in said neck, said guide member including a skirt portion extending into said container, an inwardly extending flange portion integrally formed with the end of said skirt portion, and a sealing wall, attached to the end of said flange portion, extending toward said container opening and defining an opening communicating with the contents of said container, a movable metering member, slidably engaged in said opening defined by said sealing wall, said movable metering member comprising an annular body hollow substantially throughout its height, with a diameter less than the diameter of said skirt portion of said guide member and extending beyond said container opening, including a seal portion forming a fluid tight seal with said sealing wall when said hollow annular portion is moved toward said container opening to a first sealing position, and an extension portion projecting beyond said seal portion and being closed to prevent the contents of said container from entering said movable metering member, and a sealing ring, carried by said extension portion, said sealing ring forming a fluid tight seal with said sealing wall when said hollow annular portion is moved away from said container opening to a second sealing position, a measured quantity of fluid being trapped between said sealing ring and said seal portion as said annular body is moved between said first and said second sealing positions, said trapped fluid being expelled around the bottom of the annular body as said second sealing position is reached.

11. The apparatus of claim 10 wherein said sealing ring further includes:

a stop rib, extending radially beyond said sealing ring, positioned to engage said sealing wall at said second sealing position and thereby prevent further movement of said movable metering member beyond said second sealing position.

12. The apparatus of claim 10 wherein said metering member further includes:

a stop ledge, below said seal portion, for engaging said sealing wall at said first sealing position and thereby preventing further movement of said movable metering member beyond said first sealing position.

13. The apparatus of claim 10 wherein said neck portion includes an externally threaded finish portion and which further includes:

a closure having an interiorally threaded depending skirt integrally connected with a disc portion, said closure being threadably engaged with said finish portion, said disc portion contacting said movable metering member and holding said movable metering member in said first sealing position until said closure is removed to allow dispensing of the contents of said container.

14. A package for dispensing a metered amount of fluid into a toilet flush tank which comprises, in combination:

a container for said fluid, said container including a body portion and a neck portion defining an opening into said container, a stationary guide member secured in said neck and filling the opening in said neck, said guide member including a sealing wall defining an opening communicating with the contents of said container, a float member, hollow substantially throughout its height and having a closed top, slidably mounted on said guide member, said float member having two longitudinally spaced-apart sealing surfaces for sealingly engaging said sealing wall in a first sealing position in communication with the contents of said container and a second sealing position in communication with said flush tank, and means for mounting said package in said flush tank with said float member downward, whereby said float member will be in said first sealing position when said tank is full and will move to said second sealing position when said tank is emptied, thereby dispensing into said tank a metered quantity of fluid trapped between said first and second sealing surfaces during movement from said first to said second sealing position.

15. The package of claim 14 wherein said stationary guide member includes:

a skirt portion extending into said container, and an inwardly extending flange portion integrally formed with the end of said skirt portion, said sealing wall being attached to the end of said flange portion and extending toward said container opening.

16. The package of claim 14 wherein said float member comprises:

a metering member, slidably engaged in said opening defined by said sealing wall, said metering member including an annular portion with a diameter less than the diameter of said stationary guide member and extending beyond said container opening, a seal portion defining said first sealing surface and forming a fluid tight seal with said sealing wall when said annular portion is moved toward said container opening, thereby defining said first sealing position, and an extension portion projecting beyond said seal portion and being closed to prevent the contents of said container from entering said metering member;

a sealing ring, carried by said extension portion, defining said second sealing surface and forming a fluid tight seal with said sealing wall when said annular portion is moved away from said container opening, thereby defining said second sealing position.

17. The package of claim 16 wherein said sealing ring further includes:

a stop rib, extending radially beyond said second sealing surface, positioned to engage said sealing wall at said second sealing position and thereby prevent further movement of said float member beyond said second sealing position.

18. The package of claim 16 wherein said metering member further includes:

a stop ledge, connecting said annular portion and said seal portion, for engaging said sealing wall at said first sealing position and thereby preventing further movement of said float member beyond said first sealing position.

19. The package of claim 14 wherein said neck portion includes an externally threaded finish portion, and which further includes:

a closure having an interiorally threaded depending skirt integrally connected with a disc portion, said closure being threadably engaged with said finish portion, said disc portion contacting said float member and holding said float member in said first sealing position until said closure is removed to allow dispensing of the contents of said container.

20. In a package for dispensing metered quantities of a fluid into a toilet flush tank wherein said fluid is held within a container and wherein said package includes a movable member carried by said container and said member's position is dictated by the level of water in said flush tank and reciprocates between an upper position when said tank is filled and a lower position when said tank is emptied, the improvement in said package which comprises:

said movable member being hollow substantially throughout its height and closed at its top to prevent entry of said fluid into the movable member; and means for trapping and dispensing a measured quantity of said fluid during movement of said movable member from said upper to said lower position, said dispensing occurring as said movable member reaches said lower position.

* * * * *